United States Patent [19]

Dingler

[11] Patent Number: 4,776,556

[45] Date of Patent: Oct. 11, 1988

[54] STIFFENING DEVICE FOR LARGE AREA BOARD-SHAPED CONSTRUCTION ELEMENTS

[76] Inventor: Gerhard Dingler, Industriestrasse 20, 7274 Haiterbach, Fed. Rep. of Germany

[21] Appl. No.: 926,862

[22] Filed: Nov. 4, 1986

Related U.S. Application Data

[63] Continuation of Ser. No. 680,150, Dec. 14, 1984, abandoned.

[30] Foreign Application Priority Data

Dec. 16, 1983 [DE] Fed. Rep. of Germany ..... 3345592

[51] Int. Cl.[4] ..... E04G 9/05

[52] U.S. Cl. ..... 249/53 R; 52/309.16; 52/630; 52/827; 219/213; 249/78; 249/189; 249/192; 264/225; 264/230; 264/273

[58] Field of Search ..... 249/1, 13, 18, 134, 249/189, 53 R, 78, 135, 192; 52/173 R, 309.7, 309.16, 668, 820, 630, 827; 219/213, 528; 264/230, 231, 236, 273, 219, 225, 272.13, 275, 277

[56] References Cited

U.S. PATENT DOCUMENTS

| | | | |
|---|---|---|---|
| Re. 29,945 | 3/1979 | Scott | 249/78 |
| 1,912,065 | 5/1933 | Buchanan et al. | 249/134 |
| 2,873,529 | 2/1959 | Hogan et al. | 249/8 |
| 2,913,036 | 11/1959 | Smith | 249/DIG. 3 |
| 2,958,918 | 11/1960 | MacMillan | 249/134 |
| 3,186,679 | 6/1965 | Williams | 249/134 |
| 3,313,674 | 4/1967 | Mathews | 52/309.16 |
| 3,595,726 | 7/1971 | Middleton | 52/309.16 |
| 3,664,013 | 5/1972 | MacGuire | 219/213 |
| 3,801,072 | 4/1974 | Newberry, Jr. | 52/309.16 |
| 3,806,702 | 4/1974 | Spencer | 219/213 |
| 3,851,786 | 12/1974 | Kaempen | 52/309.16 |
| 3,875,280 | 4/1975 | Story | 264/554 |
| 4,021,518 | 5/1977 | Sharp | 264/554 |
| 4,044,514 | 8/1977 | Rubin et al. | 52/309.13 |
| 4,150,808 | 4/1979 | Sawyer | 249/189 |
| 4,290,248 | 9/1981 | Kemerer et al. | 52/309.16 |
| 4,299,171 | 11/1981 | Larson | 52/309.16 |
| 4,341,831 | 7/1982 | Kleiss | 52/309.16 |
| 4,452,025 | 6/1984 | Lew | 52/668 |
| 4,525,964 | 7/1985 | Diethelm | 52/309.16 |

*Primary Examiner*—Jay H. Woo
*Assistant Examiner*—James C. Housel

[57] ABSTRACT

Webs for reducing bending in board-shaped construction elements when in use have their main direction of load perpendicular to the board plane. The devices have a sandwich of at least one first material layer, one second material layer, and one third material layer. The third material layer lies between the other two material layers and has a substantially higher coefficient of heat expansion than the other two material layers, so as to set up contracting biasing forces in the third material layer. The third material is made of a sheet metal strip. The two other materials are made of thermosetting plastic, which sets at a temperature considerably above the working temperature of the construction element.

26 Claims, 3 Drawing Sheets

STIFFENING DEVICE FOR LARGE AREA BOARD-SHAPED CONSTRUCTION ELEMENTS

This is a continuation of application Ser. No. 680,150 filed on Dec. 14, 1984, abandoned.

The invention relates to a device for large area, board-shaped construction elements, which when in use have their main direction of load perpendicular to the board.

BACKGROUND OF THE INVENTION

If such devices are used for concrete formwork, they are known as formwork panels. They are reusable and serve for supporting the concrete unti it has set. They are used for the fabrication of masonry walls. In this case, two generally parallel formwork panels delimit the thickness of the later wall. Such formwork panels are also used, however, for ceiling boarding, the formwork of joists, the formwork of piers, etc. In service, they have to meet numerous demands which are contradictory. For example, they must be light. The reason for this is that, as individual formwork panels, they have to be hand-led if possible by a single man or if possible by two men. But, even if the formwork panels are to lifted by a crane, they should be light because in this case several formwork panels are joined together. The normally used formwork panels are heavy, since the formwork board consists of a thick sandwich board with wood as the principal constituent. The frame and the webs supporting the formwork board from behind are made of steel. The disadvantages of these formwork panels are as follows:

(a) Due to the high weight, the formwork panels are difficult to handle.

(b) Due to the high weight, only a certain number of them can be transported on trucks.

(c) The formwork panel must fit in the frame. Special production techniques have to be used here as only the frame is made of dead material, while the formwork board is made of live material.

(d) The peripheral lines of the formwork board stand out in many places on the finished concrete since the frame protrudes at least with one rib up to the concrete. With two formwork boards next to each other, there are thus three parallel, closely adjacent ribs protruding out of the finished wall.

(e) The formwork board absorbs water. As long as it is new, this is not very much. However, when it later separates into fibers, it absorbs more and more water. This means that the concrete has too little water during setting on the site and it then gets the familiar air voids.

(f) A loss of water can also take place in the narrow gaps between the edge of the formwork board and the frame. This is all the more so as the hydrostatic pressure on a, for example, 2.50 m high formwork panel with filled concrete is, after all, quite considerable.

(g) The formwork board determines by its surface quality the surface quality of the later concrete. The smoother it is, the smoother will also be the masonry wall or the ceiling or similar. Even with very high-grade formwork boards, the surface quality deteriorates over time due to separation into fibers. If the surface quality were very high, this would also have the advantage that a very thin layer of cement separates out directly next to the formwork board surface, which is desirable both for aesthetic reasons and for reasons of subsequent aftertreatment. In the case of the known devices, the formwork board is either very rough from the outset or it becomes very rough during use.

(h) When the concrete has been poured between formwork panels, it is, as is known, compacted by vibrators. In this operation, the concrete moves down very slightly. In the region of the surface of the formwork board, the concrete, of course, moves down all the more readily the smoother it is.

(i) The laitance is anything but a chemically neutral substance. Rather, it attacks metal. This means that the retaining edge of the frame legs of the formwork panel corrodes over time.

(j) For reason of equitable work distribution, building is also to take place as far as possible during the winter. During setting of the concrete, a small amount of heating occurs. Over wide temperature ranges, this is immaterial. As from a temperature of, for example, −10° C., the formwork panels dissipate so much heat that the concrete no longer sets. The heat is dissipated in particular in the region of the formwork board mounts as they, after all, come into contact with the concrete directly. Wherever the, in themselves, high-grade formwork boards have been used in sandwich design, they have a poor heat insulation. They lean heavily against the crossmembers of the formwork panel frame, and these crossmembers then act practically as cooling ribs for the area behind them. Thus, it can happen that the metal parts of the formwork panels stand out on the concrete like a grid. This makes a structure either totally or partially worthless.

Merely for the sake of weight reduction, in recent years attention has turned to formwork panels made of aluminum. However, aluminum is very expensive and can only be welded by special weldings, is attacked even more by the laitance and is dented much earlier than the formwork panels of the structure mentioned above. In aluminum formwork, the formwork board is frequently also made of aluminum. On aluminum, however, the concrete begins to cake after only the second or third formwork application, so that demolding presents problems.

OBJECT AND STATEMENT OF THE INVENTION

The object of the invention is to provide construction elements of the type mentioned at the start which are much lighter than the lightest metal formwork, which are easily producible and which, despite the low weight, are both capable of withstanding for a long time the customary rough treatment on site, and above all, are capable of absorbing the hydrostatic pressures occurring in concreting. It should be possible to deform better than has so far been the case with aluminum formwork and it should also be achieved that the surface quality of the formwork board is and remains excellent.

This object is achieved according to the invention by:

(a) a sandwich of layers of at least one first material, one second material and one third material, wherein (b) said third material lies between the two other materials, (c) said third material has a substantially higher coefficient of heat expansion than said two other materials, and (d) said third material or said two other materials is/are made of thermosetting plastic, which sets at a temperature considerably above the working temperature of the compound unit, and (e) said third material layer is under contracting biasing force in said sandwich.

In this specification, reference to material and materials refers to the material layers that make up the sandwich construction.

Such a device can also be used as a board for winter construction, it can be used as a roof for huts etc. The invention provides for prestressing the construction element. The two outer materials would actually be over-strained. However, by prestressing in precisely the opposed direction to the straining direction, the load which the plastic has to withstand is reduced. If the setting temperature is considerably above the working temperature, which can be, for example, at 130° to 150° C., the state of prestressing is frozen-in in such high temperature ranges that they are never again reached in service.

Advantageously, the invention includes the following additional features.

The first material and said second material are the same. By this feature, production and calculation is facilitated and it is easier to arrive at symetrical conditions.

The first material and said second material are made of thermosetting plastic. By this feature, the third material can be protected and, moreover, only one layer of the third material is then required. Furthermore, the third material then presents its entire surface to the first and to the second material.

The third material is metal. By this feature, such temperature coefficient ranges are reached which are, for example, just right for formwork boards.

The third material is a sheet metal strip. By this feature, it is achieved that the third material presents a very large area to the second and first materials, as such sheet metal strips are, after all, substantially two-dimensional. The prestressing forces can therefore be absorbed over a wide area.

The cross-section of said sheet metal strip is substantially smaller then the cross-section of said two other materials. By this feature, the metal percentage, and thus the weight percentage, can be kept low and the two other materials are left to form the main volume.

Reinforcing beads run in the longitudinal direction on said sheet metal strip. By this feature, the sheet metal strip remains straight and does not form a boss during cooling which, after all, would completely or partially eliminate the prestressing.

The thermosetting plastic is fiber-reinforced. By this feature a reinforcement of the plastic is achieved without the coefficient of thermal expansion of the fibers playing a, or a substantial, part.

The fiber reinforcement comprises fabric. This feature, is suitable for such processes if the device is produced by the vacuum method.

The fiber reinforcement comprises added fibers. This feature should be followed accordingly if it is intended to produce by means of a compression method, for example the SMC method.

The fiber reinforcement comprises glass fibers. With the current state of the art, this feature is preferred. In the event that carbon fibers or other fibers become cheaper and likewise reinforce the thermosetting plastic, they can also be used.

The two other materials have one neutral zone and said third material lies in said one neutral zone. By this feature, the device becomes better predictable. It is easier to arrive at symmetrical conditions. In the case of flexures, in this zone the third material is strained less or not at all and no special surface treatment of the third material, for instance roughening or the like, is required.

The two other materials have outside surfaces with a demold-draft. By this feature, better demolding is possible in production and, with regard to further other construction elements joined to this construction, a larger-area transition is obtained.

Several construction element with neutral zones are positioned angularly to one another and integrally joined together, wherein said third material has an end located in the region of the neutral zone of an adjoining construction element. By this feature, the end of the third material in particular does not have to absorb specifically high forces, so that the risk that small cracks spread from this perhaps sharp-edged end is minimized.

The construction element comprises reinforcing webs on the rear of a formwork panel. By this feature, the basic shape of such formwork panels is maintained, which is important for auxiliary equipment which is used together with formwork panels. It is then not necessary to reconstruct this auxiliary equipment to fit.

The formwork panel has a formwork board integral with said reinforcing webs. By this feature, the formwork board can be made of a single piece with the reinforcing webs. Thus, for the firt time, the reinforcing webs and the formwork board form a composite unit, which all in all results in better rigidity and results in higher loading possibilities than the previous simple contact of the formwork board on the reinforcing webs has brought.

The reinforcing webs are perimeter webs. By this feature, the previous frame can be omitted and this area also made of one piece with the formwork board.

The reinforcing webs are inside bay webs. By this feature, the invention is also applied to the inside bay webs. Indeed, it is not necessary to keep to the previous pattern of parallel webs. Rather, the inside bay webs can now also form a triangular shape, hexagonal honeycomb shapes or the like.

The parameters of the materials, their dimensions and position are selected such that the tension/compression stress diagram is only partially compensated. By this feature, it is only necessary to prestress as much as is necessary to bring the, in themselves not so strong materials, to their rated load-bearing strength.

The third material has, transverse to its longitudinal extension, recesses through which pass said two other materials. By this feature, the first and second materials can also interlink, so that the sandwich has a better composite structure.

The third material is a sheet metal strip of steel of the grade St 37/St 52. The other two materials are plastic of the grade SMC (base DMS 730) glassfiber-reinforced. In practice, these materials have proven successful from the most multifarious aspects.

At least one bubble level is cast into said construction element. By this feature, it is easy to bring the device into the correct position, for crooked formwork panels are subjected to higher loads then those calculated, and the customary safety allowance is then not required for prestressing.

Nuts are cast into said construction element. By this feature, it is easy to join the construction elements together or sling them on cranes.

The third material serves as a heating element and is connected to an electrical terminal-plug connection. By this feature, it is possible to heat the device to a certain degree. In application of the device for concrete formwork, this would have the advantage that concreting could continue even in severe frost and the concrete still sets. In using the construction element as hut roofs, the snow load or ice load can be prevented from becoming too high. It is namely adequate here if the heating output per unit area is very low.

The construction element is a board-shaped element of a temporary construction, such as a wall element of a winter construction, a roof element of a hut or the like. The construction element is a formwork board. The invention is particularly suitable for these applications.

The third material comprises a plurality of intersecting sheet metal strips having at their intersections edge-open recesses for receiving an intersecting sheet metal strip. By this feature, the sheet metal strips interlink and they can run between the same spatial planes. It is therefore not necessary to make the construction elements higher because sheet metal strips have to run in them.

DESCRIPTON OF THE DRAWINGS

The invention will now be explained with reference to a preferred exemplary embodiment. In the drawings.

DETAILED DESCRIPTION

Figure 1:
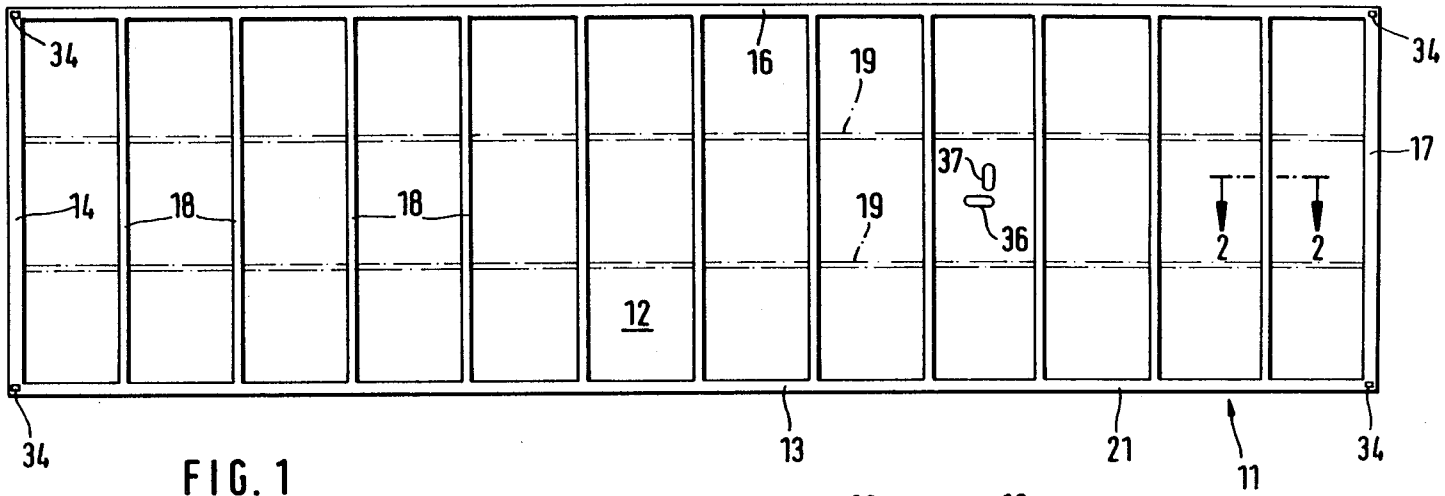
FIG. 1 shows the rear view of a 2640 mm long and 750 mm wide formwork board.

A formwork panel 11 has a formwork board 12, four perimeter webs 13, 14, 16, 17 and, parallel with the perimeter webs 14, 16, a relatively large number of inside bay webs 18, which are about 22 cm distant from one another. As shown by the broken lines 19, other webs of the same form as the inside bay webs 18 can be provided at equal distance and parallel with the perimeter webs 16, 13. The perimeter webs 13 to 17 have a width of 2.3 cm and are thus quite substantially narrower than the previously existing perimeter webs made of steel or aluminum. The inside bay webs 18 have a width of 6 mm, which likewise is quite substantially less than the previous inside bay webs had. The perimeter webs 13 to 17 and the inside bay webs 18 and also the webs which may exist as shown by the broken lines 19 are to a slight extent conical out of the plane of the drawing of FIG. 1, with the exception of the perimeter areas 21 of the perimeter webs 13, 14, 16, 17, which perimeter areas 21 stand upright relative to the plane of the drawing of FIG. 1. Such a formwork panel 11 weighs approximately 30 to 32 kg, which means a considerable saving in relation to an aluminum formwork of 39 kg or even a steel frame formwork of 68 kg.

Figure 2:
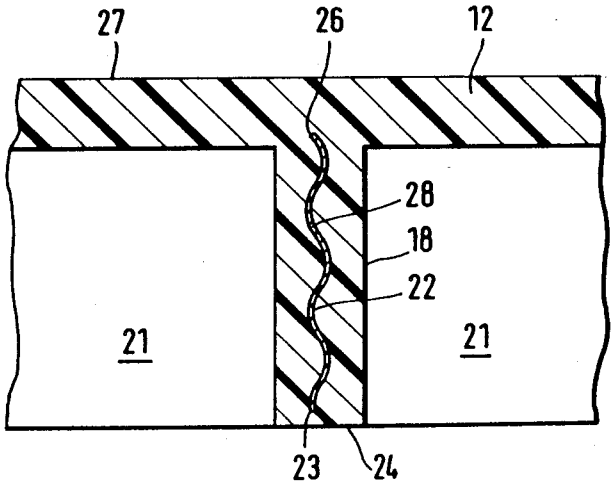
FIG. 2 shows a cross-section along the line 2—2 in FIG. 1.

The inside bay webs 18 are 96 mm high. In them, a metal sheet strip 22 is provided, as shown in FIG. 2, in the center plane or meandering about this plane. Its bottom end 23, as shown in FIG. 2, has a small distance from face 24 of the associated inside bay web 18. The top end 26 protrudes so far into the formwork board 12 that it is essentially in the neutral zone of the formwork board 12. Because the formwork board 12 is, after all, still joined to the perimeter webs 13 to 17 and the inside bay webs 18, the neutral zone of the formwork board 12 is not for instance in its center, but offset further down, as shown in FIG. 2. The formwork board 12 has on its top surface 27, as shown in FIG. 2, a roughness which is negligible in this trade.

The sheet metal strip 22 is 1 mm thick and is made of steel of type St 37. It is corrugated with waves 28 like corrugated sheet. With the exception of the sheet metal strip 22, the material of the formwork board 12 and of the inside bay web 18 is made of glassfiber-reinforced thermosetting plastic having a coefficient of expansion $\alpha t$ value of $14\times10^{-6}$. The sheet metal strip 22 has a higher $\alpha_T$ value of $21\times10^{-6}$.

Figure 7:
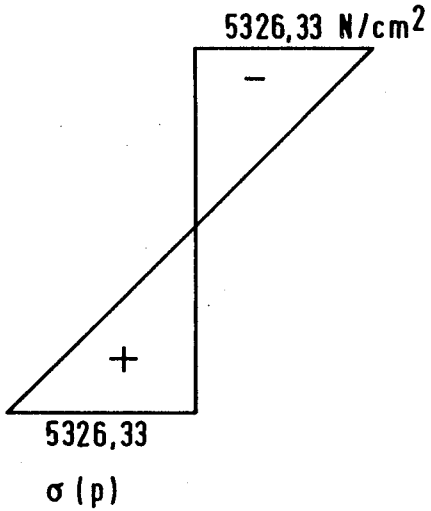
FIG. 7 shows the stress diagram of an inside bay web without sheet metal strips.

FIG. 7 shows the stress diagram for the inside bay web 18 in the zero state with applied service load. The minus sign refers to compressive force and the plus sign to tensile force. Where the two fields meet is the neutral zone. In the example there are 5326.33 N/cm$^2$. An SMC glassfiber-reinforced plastic based on DSM 730, for example, would withstand this load. However, the deflection of inside bay web 18 would then be much too great, i.e. area 27 would bulge.

Figure 8:
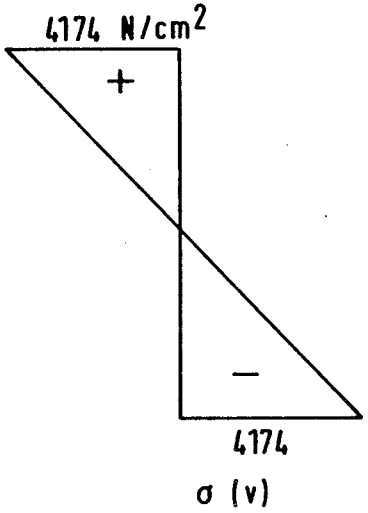
FIG. 8 shows the stress diagram produced by the prestressing.
Figure 9:
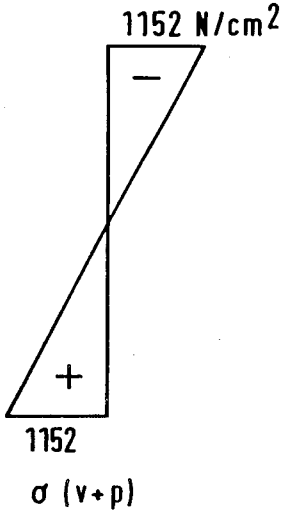
FIG. 9 shows the stress diagram resulting from the superimposition of FIGS. 7 and 8.

FIG. 8 shows how the sheet metal strip 22 then exerts a precisely opposed prestress of 4174 N/cm$^2$. If one then observes the complete inside bay web 18, superimposition produces the stress diagram shown in FIG. 9, i.e. the difference between FIG. 7 and FIG. 8, and the deflection has become correspondingly smaller by this difference, i.e. acceptable in practice.

The prestressing is produced by introducing the glassfiber-reinforced plastic and the sheet metal strips 22 into a mold. The glassfiber-reinforced plastic then reacts chemically and, since this process is exothermic, heat in the range of 130° C. is generated. This heat is also transmitted to the thermically quick-reacting sheet metal strip 22, which then expands relative to the materials surrounding it. At this temperature of 130° C., the thermosetting material then becomes hard and bonds with the sheet metal strip 22. Although the complete element then cools, the sheet metal strip 22 remains bonded with the material and at this stage shrinks relative to the set plastic. This causes the prestressing as shown in FIG. 8 of 4174 N/cm$^2$ in the region of the highest compression or of the highest tension.

The plastics do not have any cold creep characteristics. These would also be prevented by the use of fibers. The plastic used can be nailed with steel nails. It is waterrepellent and does not accept concrete. The materials are commercially freely available. For example, the companies Bayer and Hoechst supply the material DSM 730. The glassfiber-reinforced plastic SMC can be made up by yourself or bought ready-to-use, so that it only has to be mixed with an activator before introduction into the mold. Plastic and glassfibers are available everywhere, they are by no means rare materials. If needs be, they can be patched in the way in which boat hulls, gliders or the like are patched.

Figure 3:
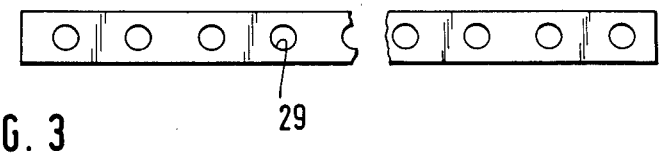
FIG. 3 shows the side view of a sheet metal strip.

In FIG. 3, the sheet metal plate has holes 29, through which the plastic material can bond, so that a positive connection also takes place and the plastic does not adhere to the surface of the sheet metal plate 22.

Figure 4:
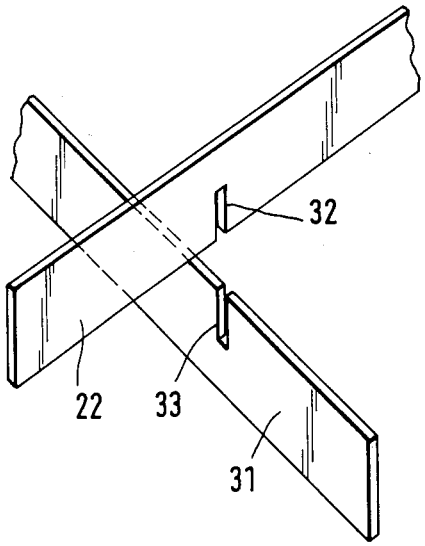
FIG. 4 shows the perspective view of the intersection region of two sheet metal strips.

FIG. 4 shows how the sheet metal plate 22 can be shaped if it crosses another sheet metal plate 31. The sheet metal plate 22 is then provided with a notch 32, which extends somewhat more than to half of the sheet metal plate 22 and is wider than the sheet metal plate 31 is thick. Conversely, a notch 33 is made in sheet metal strip 31, so that by fitting the sheet metal strips 22, 31 into each other, an intersection can form. A small excess in the notches 32, 33 is adequate to allow the sheet metal strips 22, 31 to stretch slightly at the temperature of 130° C.

If materials are used, the coefficients of thermal expansion of which have an even higher differential, the prestressing is even higher. The same is achieved if plastics are used which react and solidify at even higher temperatures, because then the sheet metal strip 22, and where applicable 31 as well, expand(s) even more and is frozen-in in this even greater expansion.

Simply for the sake of simplicity, it was assumed in the above description that only the inside bay webs 18 have such sheet metal strips 22. It goes without saying that sheet metal strips can also be provided analogously in the perimeter webs 13, 14, 16, 17. If webs are also provided as shown by the broken lines 19, they also contain sheet metal strips.

The invention can also be supplemented to the effect that sheet metal material is also provided in the formwork board 12, either inserted as a strip or better as a sheet metal plate, which is not solid however but has holes as per the holes 29 from FIG. 3.

FIG. 1 shows that nuts 34 are cast-in at the corner regions of the formwork panel 11. A screw can be screwed into these in the viewing direction of FIG. 1. Furthermore, a bubble level 36 and, perpendicular to it, a bubble level 37 can be formed in one of the bays visible in FIG. 1, so that it is later possible to see whether the formwork panel 11 also stands true.

Figure 5:
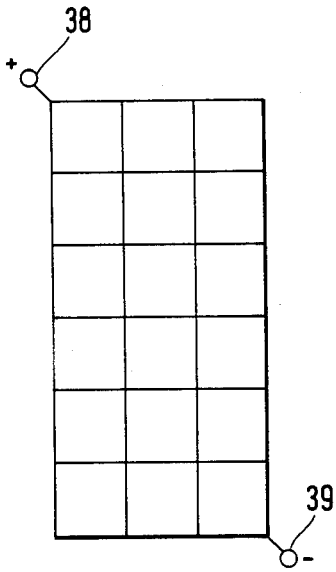
FIG. 5 shows a first electrical connection possibility of the sheet metal strips.

It is easy to connect the abovementioned system of sheet metal strips electrically. This is shown by FIG. 5 for an exemplary embodiment. There, the left-hand top corner region is connected to a terminal 38 and the right-hand bottom region to a terminal 39. It is readily possible, without altering the mechanical prestressed characteristic, to heat up the formwork board 12 to such an extent that it does not become colder than −10° C., for example. The thermal load of the entire device is low in that case.

In a circuit arrangement as shown in FIG. 5, the sheet metal strips must be electrically connected to one another at the intersections or the abutting points, which can be readily achieved by means of wires simply serving for the electrical connection.

Figure 6:
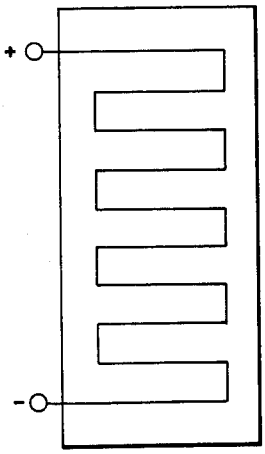
FIG. 6 shows a second possibility for electrical connection of the sheet metal strips.

FIG. 6 shows that the sheet metal strips can also be heated up in another way, namely by connecting up in series.

The device according to the invention has a substantially higher service life than all known devices. The number of the devices according to the invention used is likewise substantially higher than the known devices. Since the material coming into contact with the concrete is dead plastic material, this material is insensitive to concrete. In rough treatment on site, the device is much less susceptible to damage. For example, steel and in particular, aluminum are left with dents if a stack of devices collapses, is hit or such like. The device according to the invention absorbs such forces resiliently and returns to its initial position. In the event that cracks actually do occur, they can be repaired just as well by the unskilled as cracks in leisure objects can be repaired by the unskilled.

I claim:

1. A large-area, board-shaped construction element comprising a board plane expected to reach predetermined working temperatures when in use and a device integrally attached to said board plane for reducing bending of said board plane, said device comprising:

(a) a sandwich of at least one layer of a first material, one layer of a second material and one layer of a third material, the orientation of each of said layers of said sandwich being subtantially perpendicular to said board plane, wherein (b) said third material layer lies between the two other material layers, (c) said third material layer has a substantially higher coefficient of heat expansion than said two other material layers, (d) the two other material layers are made of thermosetting plastic, which sets at a temperature considerably above said working temperatures of said construction element, and (e) said third material layer is under contracting biasing force in said sandwich.

2. A construction element as claimed in claim 1, wherein said first material and said second material are the same.

3. A construction element as claimed in claim 1, wherein said third material is metal.

4. A construction element as claimed in claim 3, wherein said third material is a sheet metal strip.

5. A construction element as claimed in claim 4, wherein said sheet metal strip has a transverse cross-section that is substantially smaller than that of said two other material layers.

6. A construction element as claimed in claim 5, comprising corrugations running transverse to the longitudinal direction on said sheet metal strip.

7. A construction element as claimed in claim 3, comprising an electrical terminal-plug connection, wherein said third material layer serves as a heating element and is connected to said electrical terminal-plug connection.

8. A construction element as claimed in claim 1, wherein said thermosetting plastic is fiber-reinforced.

9. A construction element as claimed in claim 8, wherein the fiber reinforcement comprises fabric.

10. A construction element as claimed in claim 8, wherein the fiber reinforcement comprises added fibers.

11. A construction element as claimed in claim 8, wherein the fiber reinforcement comprises glass fibers.

12. A device as claimed in claim 1, wherein said two other material layers have one elongated neutral zone and said third material layer extends longitudinally with respect to said one neutral zone.

13. A construction element as claimed in claim 1, wherein said two other material layers have outside surfaces with a draft that enables the device to be withdrawn from a mold.

14. A construction element as claimed in claim 1, wherein said board plane has a neutral zone, and said sandwich is integrally joined to said board plane, wherein said third material layer has an end located in the region of said neutral zone of said board plane.

15. A construction element as claimed in claim 1, wherein said board plane comprises a formwork panel and said device comprises reinforcing webs on a rear surface of said formwork panel.

16. A construction element as claimed in claim 15, wherein said reinforcing webs are perimeter webs.

17. A construction element as claimed in claim 15, wherein said reinforcing webs are inside bay webs.

18. A construction element as claimed in claim 1, wherein said first, second and third material layers, have parameters, dimensions and positions selected such that tension/compression stress created in said sandwich under service load is only partially compensated.

19. A construction element as claimed in claim 1, wherein said third material layer has a longitudinal extension and recesses there along through which pass said two other materials.

20. A construction element as claimed in claim 1, wherein said third material layer is a sheet metal strip of steel of the grade St 37/St 52.

21. A construction element as claimed in claim 1, wherein said two other material layers are comprised of sheet molding compound plastic glassfiber-reinforced.

22. A construction element as claimed in claim 1, comprising at least one bubble level cast into said construction element.

23. A construction element as claimed in claim 1, comprising nuts cast into said construction element.

24. A construction element as claimed in claim 1, wherein said construction element is adapted for temporary use.

25. A construction element as claimed in claim 1, wherein said construction element is a formwork board.

26. A construction element as claimed in claim 1, wherein said third material layer comprises a plurality of intersecting sheet metal strips having at their intersections edge-open recesses for receiving one another.

* * * * *